US006892684B2

(12) United States Patent
Pattakos et al.

(10) Patent No.: US 6,892,684 B2
(45) Date of Patent: May 17, 2005

(54) VARIABLE VALVE GEAR

(76) Inventors: Manousos Pattakos, Lampraki 356, Nikea Piraeus, P.C 184 52 (GR); John Pattakos, Lampraki 356, Nikea Piraeus, P.C 184 52 (GR); Emmanouel Pattakos, Lampraki 356, Nikea Piraeus, P.C 184 52 (GR)

( * ) Notice: Subject to any disclaimer, the term of this patent is extended or adjusted under 35 U.S.C. 154(b) by 0 days.

(21) Appl. No.: 10/480,220

(22) PCT Filed: Jun. 14, 2002

(86) PCT No.: PCT/GR02/00035

§ 371 (c)(1),
(2), (4) Date: Dec. 10, 2003

(87) PCT Pub. No.: WO02/103169

PCT Pub. Date: Dec. 27, 2002

(65) Prior Publication Data

US 2004/0144346 A1 Jul. 29, 2004

(30) Foreign Application Priority Data

Jun. 18, 2001 (GR) ..... 20010100295

(51) Int. Cl.[7] ..... F01L 1/34

(52) U.S. Cl. ..... 123/90.16; 123/90.15; 123/90.17; 123/90.27; 123/90.31; 123/90.39; 123/90.44; 123/198 F; 74/569; 74/579 R

(58) Field of Search ..... 123/90.15–90.17, 123/90.2, 90.22, 90.23, 90.27, 90.31, 90.39, 90.4, 90.44, 90.45, 90.48, 90.52, 90.55, 90.61, 90.64, 198 F; 74/828–831, 838, 42, 54, 519, 559, 579 R, 580, 569; 251/231–236, 242–244, 248

(56) References Cited

U.S. PATENT DOCUMENTS

| | | | | | |
|---|---|---|---|---|---|
| 4,612,887 | A | * | 9/1986 | Yoshizaki | 123/198 F |
| 4,768,467 | A | * | 9/1988 | Yamada et al. | 123/90.16 |
| 5,056,476 | A | * | 10/1991 | King | 123/90.16 |
| 5,205,247 | A | * | 4/1993 | Hoffman | 123/90.16 |
| 5,365,895 | A | * | 11/1994 | Riley | 123/90.16 |
| 5,456,224 | A | * | 10/1995 | Riley | 123/90.16 |
| 5,899,180 | A | * | 5/1999 | Fischer | 123/90.16 |
| 6,055,949 | A | * | 5/2000 | Nakamura et al. | 123/90.16 |

* cited by examiner

*Primary Examiner*—Thomas Denion
*Assistant Examiner*—Kyle M. Riddle

(57) ABSTRACT

A variable valve gear particularly for internal combustion engines, in which a control cam of a camshaft acts, by way of pair of swivellably coupled levers, to a valve to produce an adjustment of the valve stroke. The valve stoke can vary continuously from a maximum lift to zero lift while the valve clearance can remain unchanged.

14 Claims, 14 Drawing Sheets

VARIABLE VALVE GEAR

The invention provides a variable valve gear particularly for internal combustion engines, in which a control cam of a camshaft acts, by way of a pair of swivellably coupled levers, to a valve to produce an adjustment of the valve stroke. The valve stroke can vary continuously from a maximum value to zero while the valve clearance is held unchanged.

In the prior art several variable valve gear mechanisms are described. The objective is always the adjustment, continuous if possible, of valve operation, as regards valve stroke and valve timing, so that the breathing of the engine being the best for the particular operational conditions. Some of the most relevant patents are: U.S. Pat. No. 5,899,180, U.S. Pat. No. 5,373,818, U.S. Pat. No. 5,205,247, U.S. Pat. No. 5,732,669, U.S. Pat. No. 5,056,476, U.S. Pat. No. 6,145,485, U.S. Pat. No. 6,032,624, U.S. Pat. No. 4,502,426, U.S. Pat. No. 5,937,809, U.S. Pat. No. 6,029,618, U.S. Pat. No. 5,996,540, U.S. Pat. No. 5,988,125, U.S. Pat. No. 6,055,949, U.S. Pat. No. 6,123,053, U.S. Pat. No. 6,019,076, U.S. Pat. No. 5,003,939 and U.S. Pat. No. 5,365,895.

The advantages of a continuously variable valve gear are known to those relative to the art. Some of the side effects are the extra cost, the lower revs limit, the involvement of strong springs, the complication in assembly and service, the extra height, the friction loss, the noise.

Achieving slight valve strokes allows for elimination of the throttle valve resulting in reduced consumption, reduced pollution and better performance, especially at partial loads, without compromise in power output.

In the present invention the additional components are fewer, in some realizations two additional pieces per valve, plus a control shaft per row of valves, they can be light, especially those ones bound to move quickly, they can be small in dimensions, so the engine's height can be low, they do not need special construction accuracy, the restoring force, for secure contact of cam follower to control cam, is generated basically by the valve spring, so additional strong restoring springs are not a necessity, the resulting thrust force to the valve's bucket lifter or to the valve's rocker arm is small, especially at high valve strokes and high revs, the throttle in the induction system is necessary no more since the stroke of the valve can vary from a maximum to zero, the friction is small.

The closest prior art is the U.S. Pat. No. 5,899,180 of Fischer, where the rotation of a control shaft, which serves a row of valves, changes the valve timing and stoke in a continuous manner. In that patent an arm has a roller, at one end, which rolls on a control cam of a camshaft. The arm is rotatably supported, at its other end, about an axis. As this axis moves along a path, due to the rotation of the control shaft, the resulting stroke/timing of the valve is changing continuously. The roller moves along a circular arc. As this circular arc changes position relative to the circular arc contact surface of the roller on the rocker arm, the valve stroke and the valve timing changes. When the two arcs are "vertical" to each other, the valve stroke is long. When the two arcs are "parallel" the resulting valve stroke is small. So, by rotating the control shaft, the stroke/timing of a row of valves is controlled In the present invention there is also a control shaft. This control shaft can rotate about a, fixed to the engine, axis. For each valve in a row there are two levers, the valve lever and the control lever, swivellably coupled at one end. The control lever is rotatably supported, at its other end, to the control shaft to rotate about a movable axis, like the arm with the roller in U.S. Pat. No. 5,899,180 patent. The valve lever is swivellably coupled, at its other end, to the valve's rocker arm or to the valve's bucket lifter, that is to the valve displacing device. The cam follower is pushed by the control cam of the camshaft, forcing the swivel joint coupling the control lever and the valve lever to oscillate along an arc whose center is the movable axis on the control shaft. The swivel joint coupling the valve lever and the valve's rocker arm or valve's bucket lifter, can move also along a path, circular in case of a rocker arm and linear in case of a bucket lifter. Depending on the relative position of the two paths, that one of the swivel joint coupling the control lever and the valve lever, and that one of the swivel joint coupling the valve lever and the rocker arm or bucket lifter, the stroke of the valve changes continuously from a maximum to zero. The more "parallel" the two paths, the longer the valve stroke.

By selecting the effective lengths of control and valve levers, and by selecting the position of the rotation axis of the control shaft, constant valve clearance and continuously adjusted valve stroke, from a maximum value to zero, are achievable.

To secure contact of the cam follower to the control cam, particularly at short and very short valve strokes, an additional spring element can be inserted to assist this contact. In case of long valve strokes the necessary restoring force comes from the valve spring, so the spring element mentioned can stay inactive.

The system described in this patent in combination with some variable valve timing system provides a completely controlled variable valve gear system.

Figure 1:
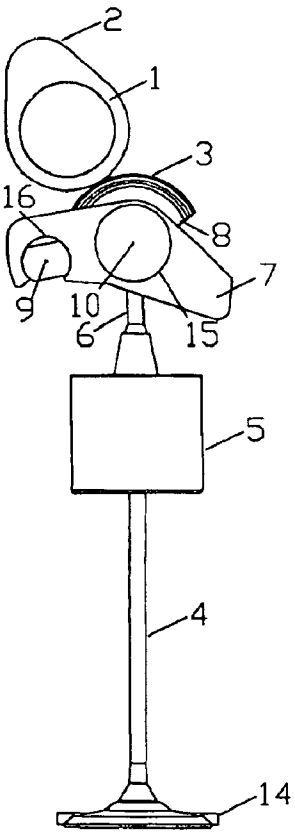
FIG. 1 shows a realization of the proposed variable valve gear.
Figure 4:
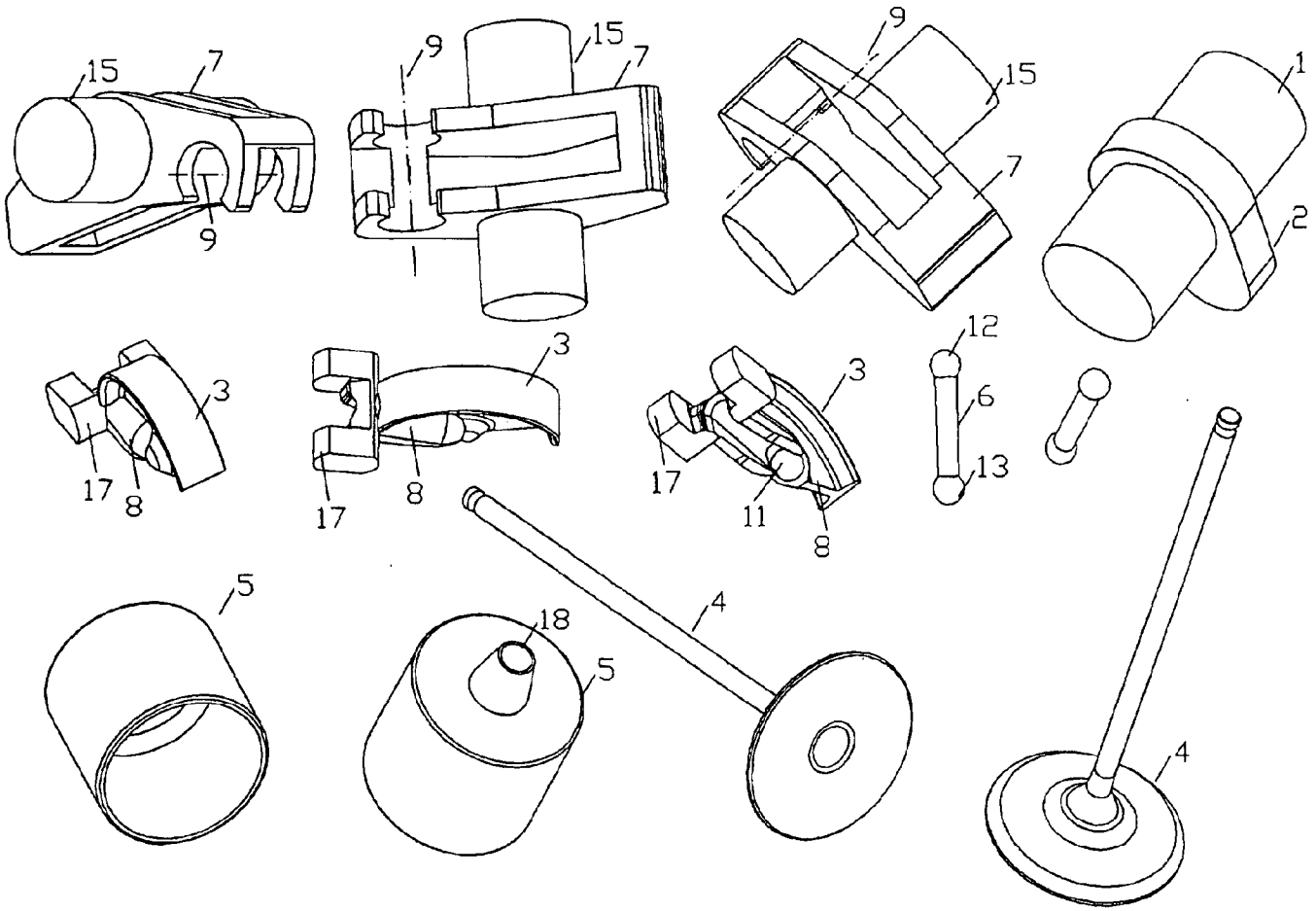
FIG. 4 shows, from various points of view, the main constituents of the mechanism of FIG. 1.
Figure 8:
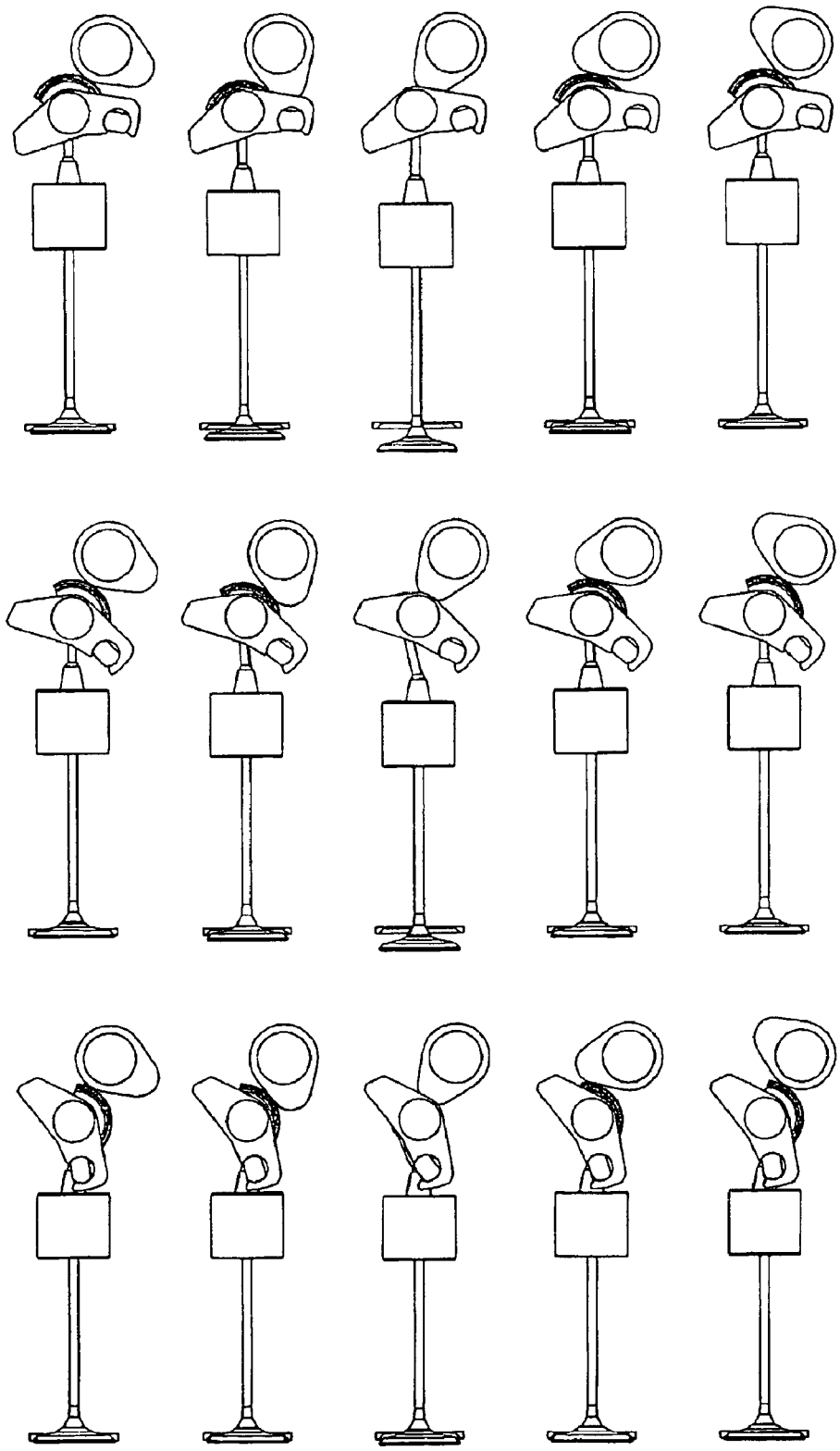

FIG. 8 shows a temporal course of the operation of the mechanism of FIG. 1. In the upper row the mechanism is adjusted for long valve stroke, in the intermediate row the mechanism is adjusted for medium valve stroke and in the lower row the mechanism is adjusted for short valve stroke. The five stages shown in each row correspond to 180 degrees total rotation of the camshaft, of 45 degrees steps.

Figure 9:
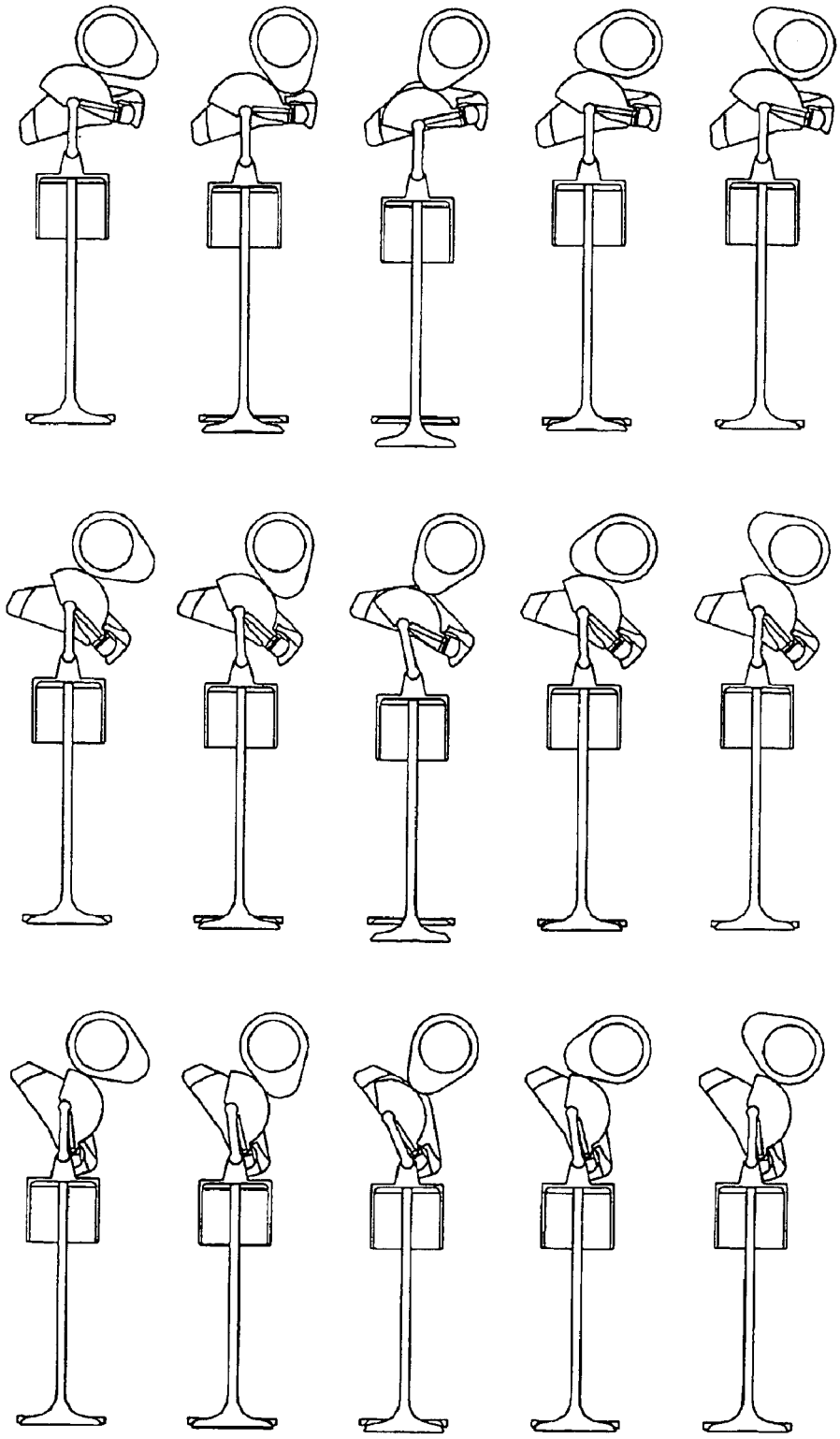

FIG. 9 shows in sectional view what is shown in FIG. 8.

Figure 10:
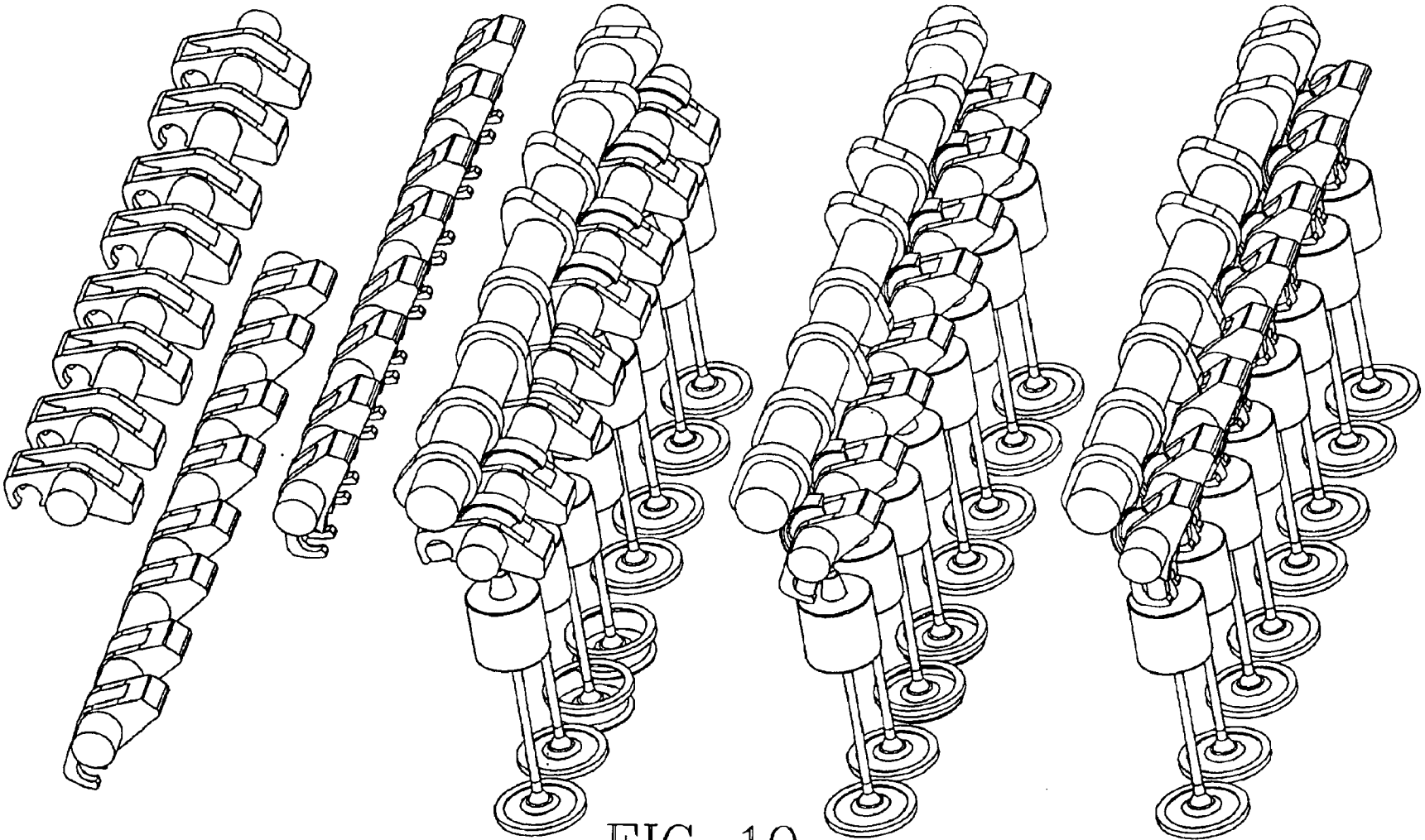

FIG. 10 shows a row of 8 valves controlled by a common control shaft. They could, for instance, be the intake or the exhaust valves of a four in line, sixteen valve, four cycle typical engine. The control shaft or adjusting device is shown alone at left, from three different points of view. In the third, from right, assembly the control shaft is rotated to give long valve stroke. In the second, from right, assembly the control shaft or adjusting device is rotated to give a medium valve stroke. In the right assembly the control shaft or adjusting device is rotated for zero valve stroke.

Figure 11:
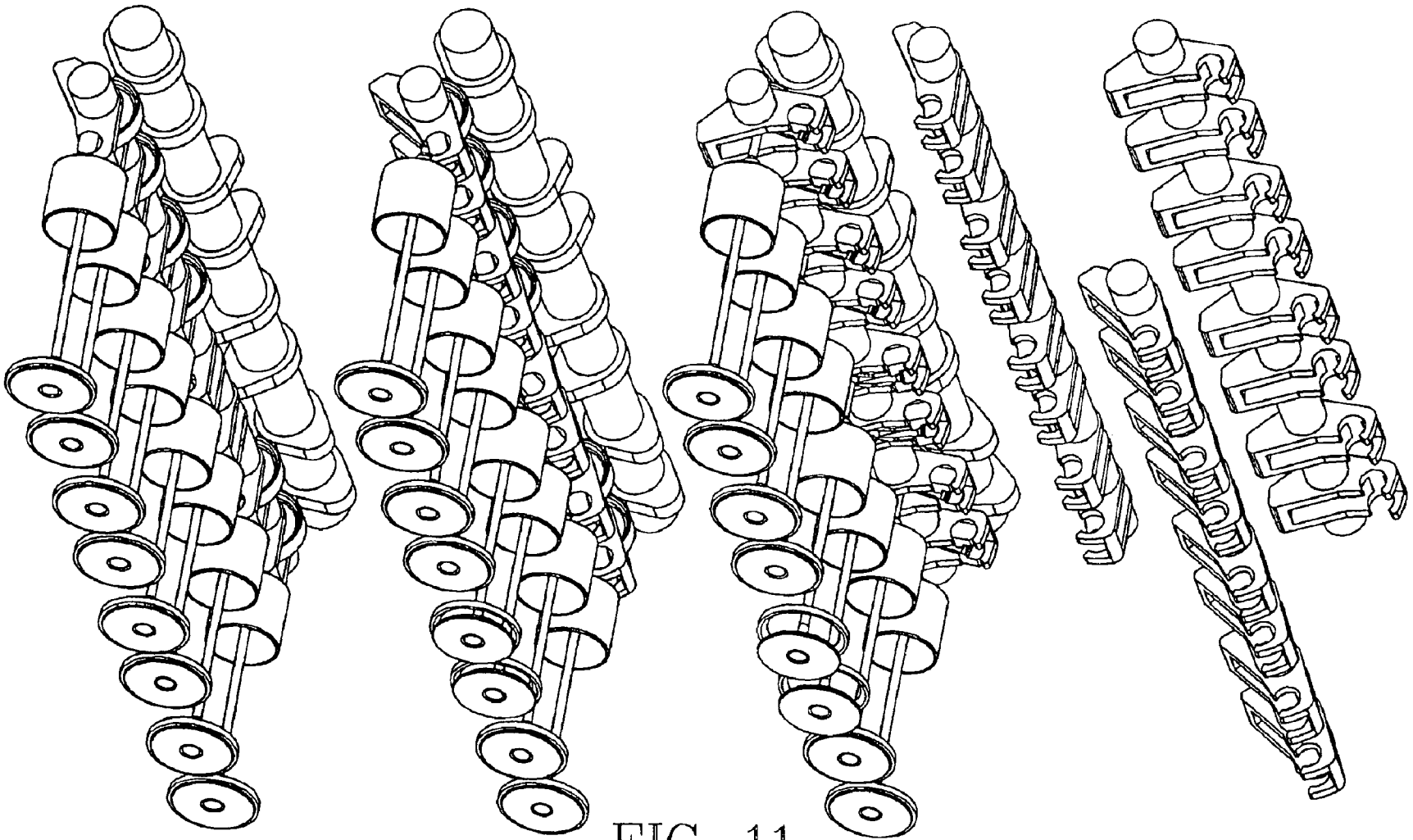

FIG. 11 shows, from another point of view, what is shown in FIG. 10.

Figure 12:
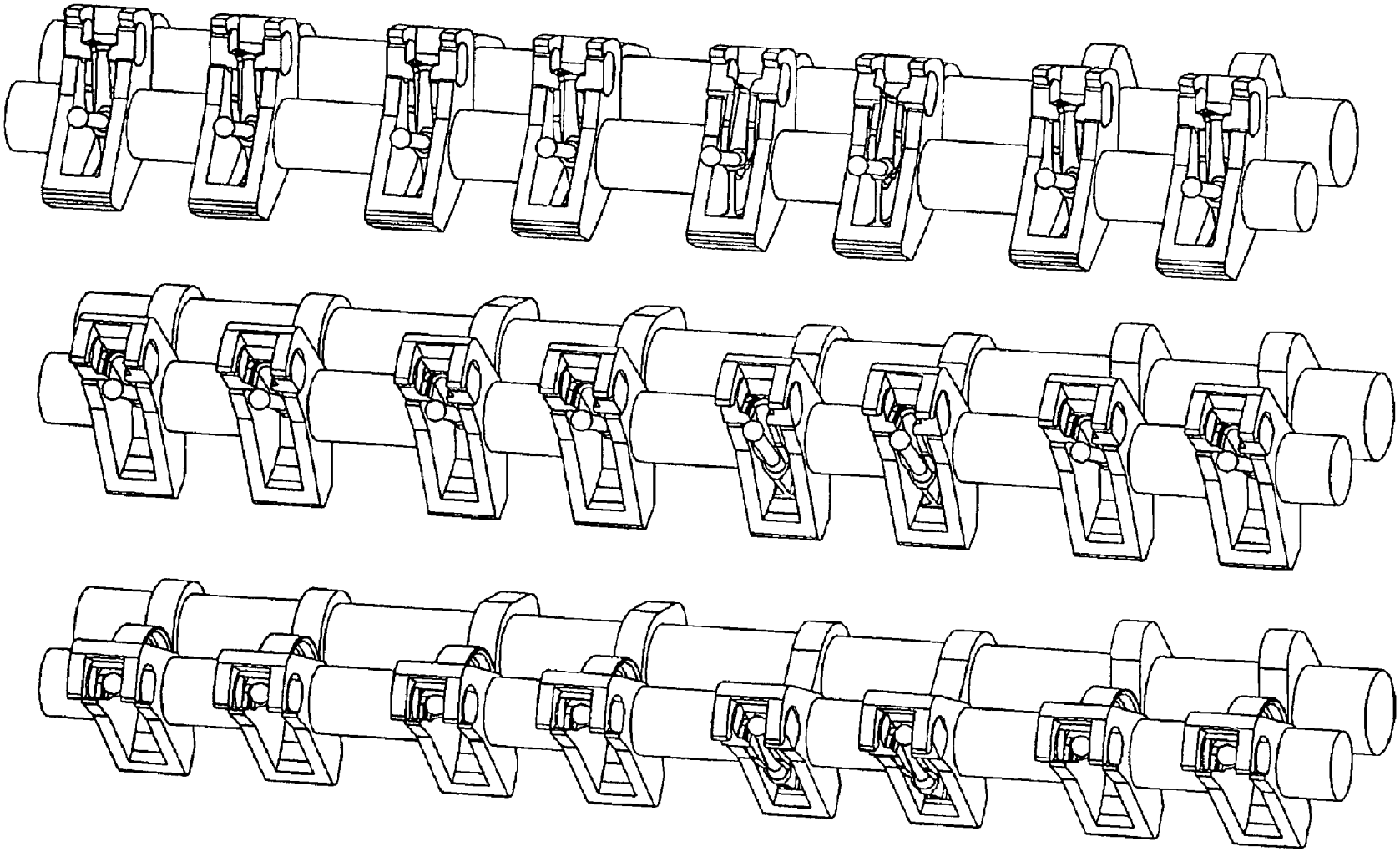

FIG. 12 shows the assembly of FIGS. 10 and 11 with the valves and the valve bucket lifters removed, for better understanding. Here they are shown the valve levers, the control levers, the common control shaft, or adjusting device, and the camshaft.

Figure 13:
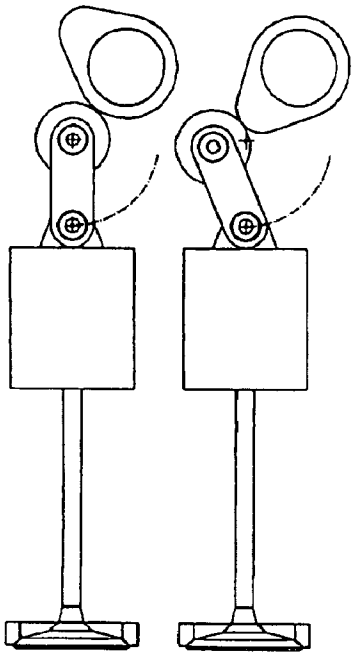

FIG. 13 shows another realization. Here the cam follower is a roller rotatably supported to valve lever either to control lever. The rotation axis of the control lever is in a position, on the path drawn with dashed dot line, for zero valve stroke. The mechanism is shown for two different angles of the camshaft.

Figure 16:
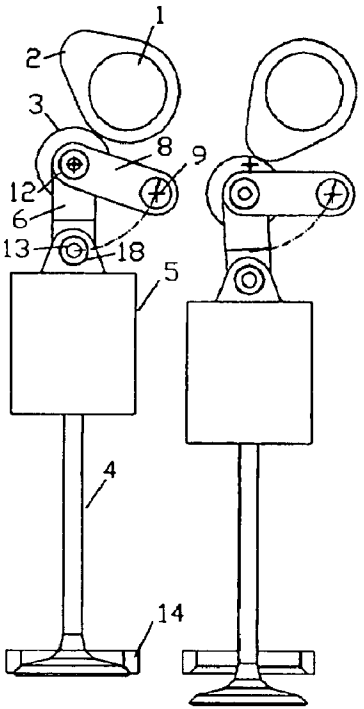
Figure 15:
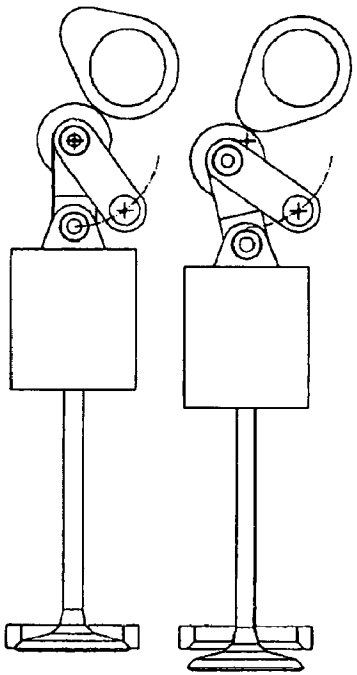
Figure 14:
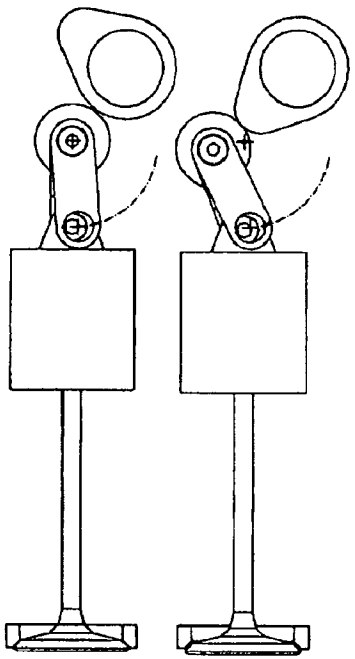

In FIGS. 14, 15 and 16 it is shown the mechanism of FIG. 13, for three other conditions of the adjusting device. In FIG. 14 the valve stroke is very short, in FIG. 15 the valve stroke is medium and in FIG. 16 the valve stroke is long. The operation of the mechanism is similar, for the rest, to the mechanism of FIG. 1.

Figure 17:
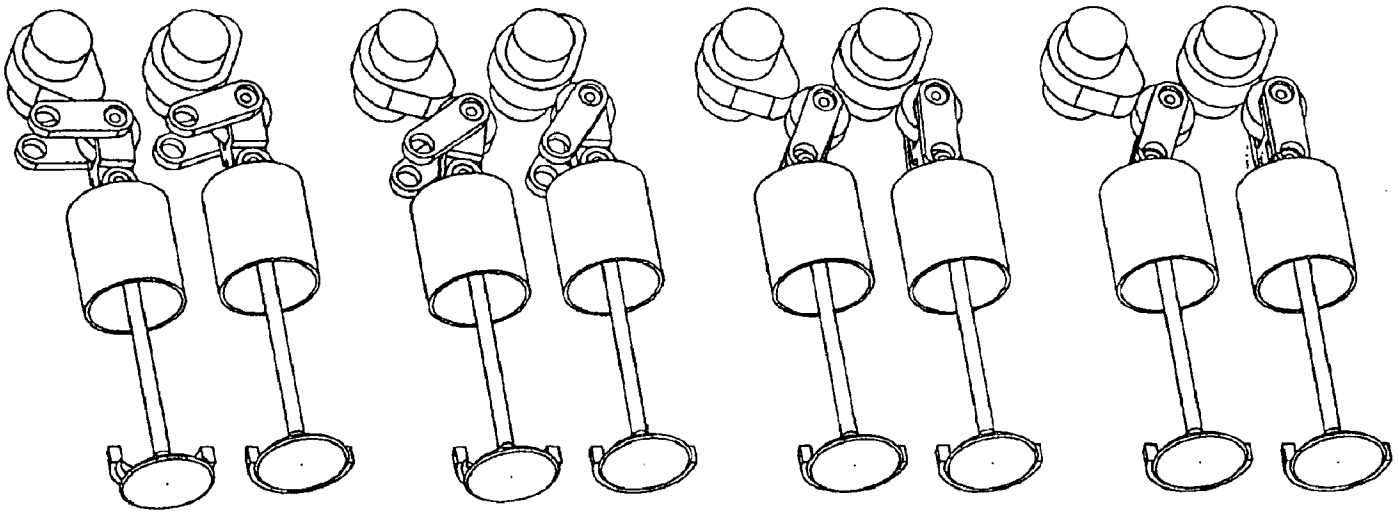
Figure 18:
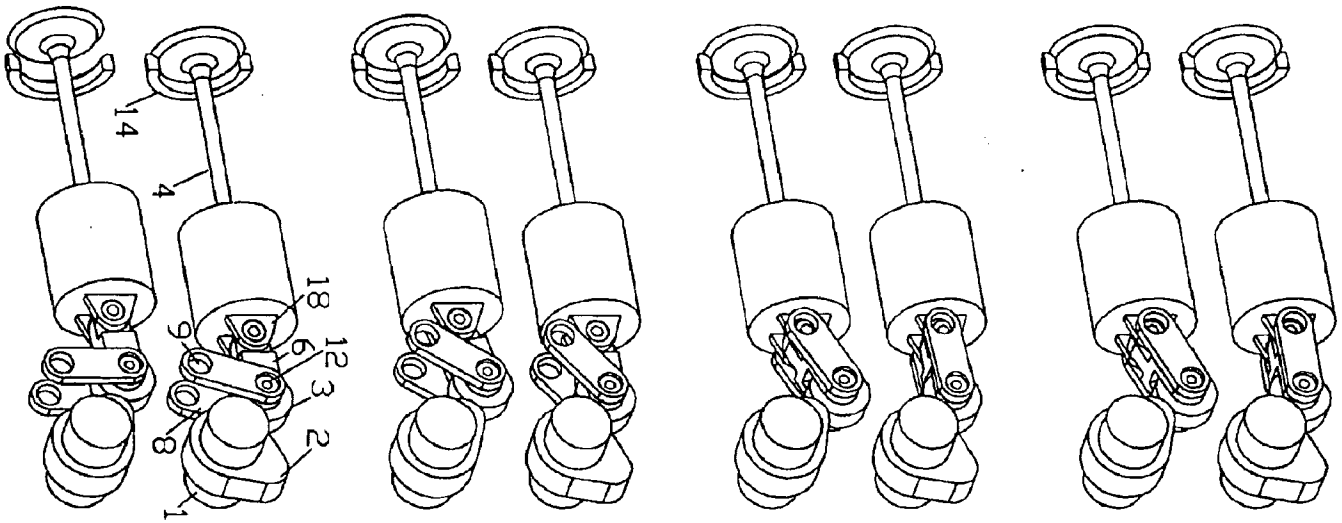

In FIGS. 17 and 18 it is shown the mechanisms of FIGS. 13 to 16 from other points of view.

Figure 19:
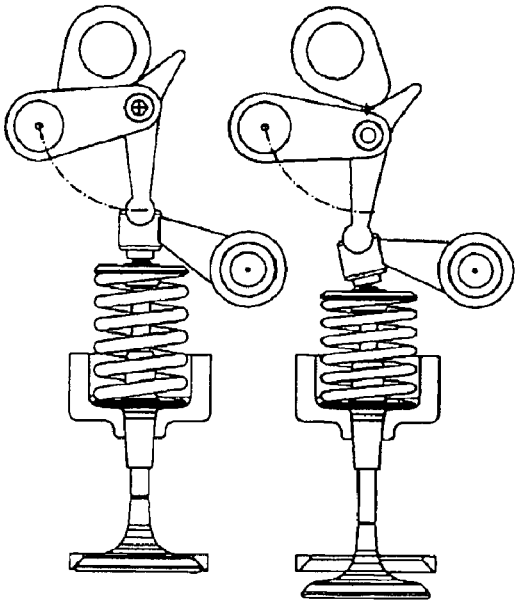

FIG. 19 shows another realization of the present invention, for two angles of the camshaft. Here the displacing valve mechanism is a rocker arm. The valve lever is swivellably coupled to the rocker arm, with the swivel joint being a cylindrical surface, at the end of the valve lever, rotating in a corresponding cylindrical journal formed on the rocker arm. Another difference from the previous mechanisms is that the cam follower is mounted on the valve lever. The shape of the cam follower is a plane surface but it could also be any other shape, as it is secured to the valve lever. Even so the clearance can remain constant, no matter what is the condition of the control shaft, and the valve stroke can change from a maximum to zero.

Figure 20:
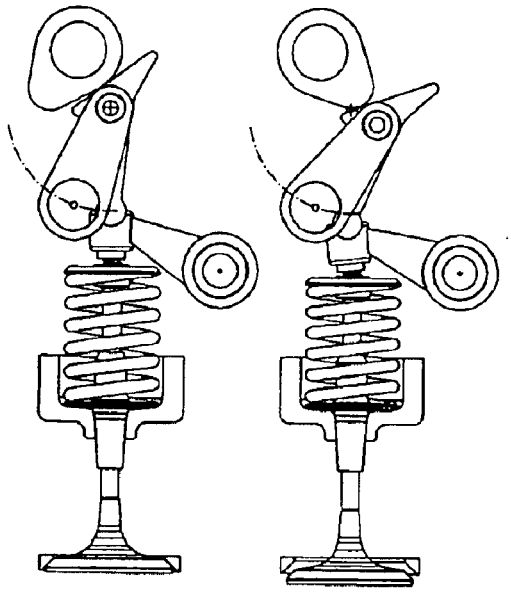

FIG. 20 shows the mechanism of FIG. 19 adjusted to offer a shorter valve stroke.

Figure 21:
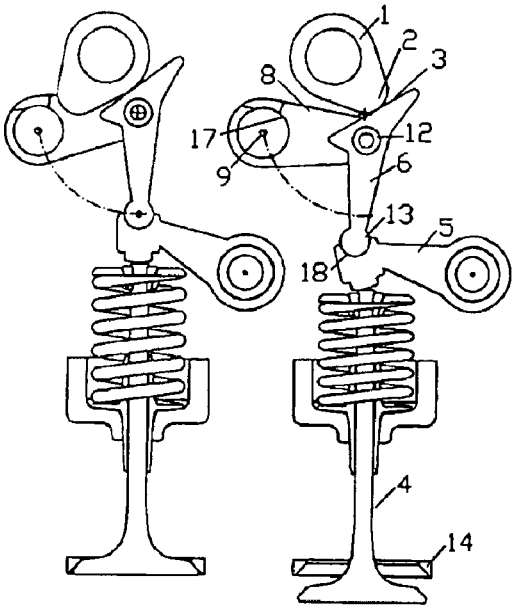
Figure 22:
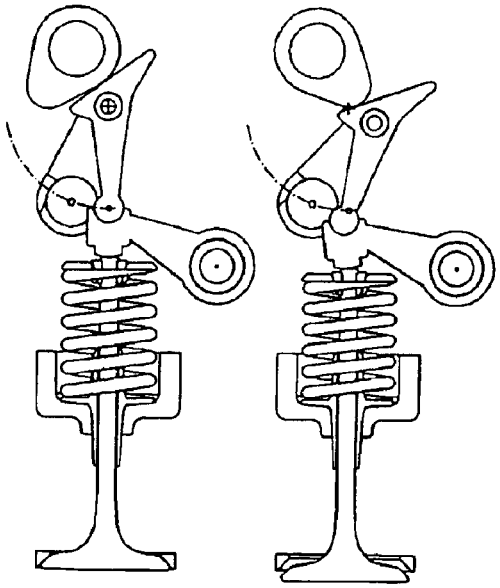

In FIGS. 21 and 22 they are shown the mechanisms of FIGS. 19 and 20 correspondingly, in sectional views.

Figure 23:
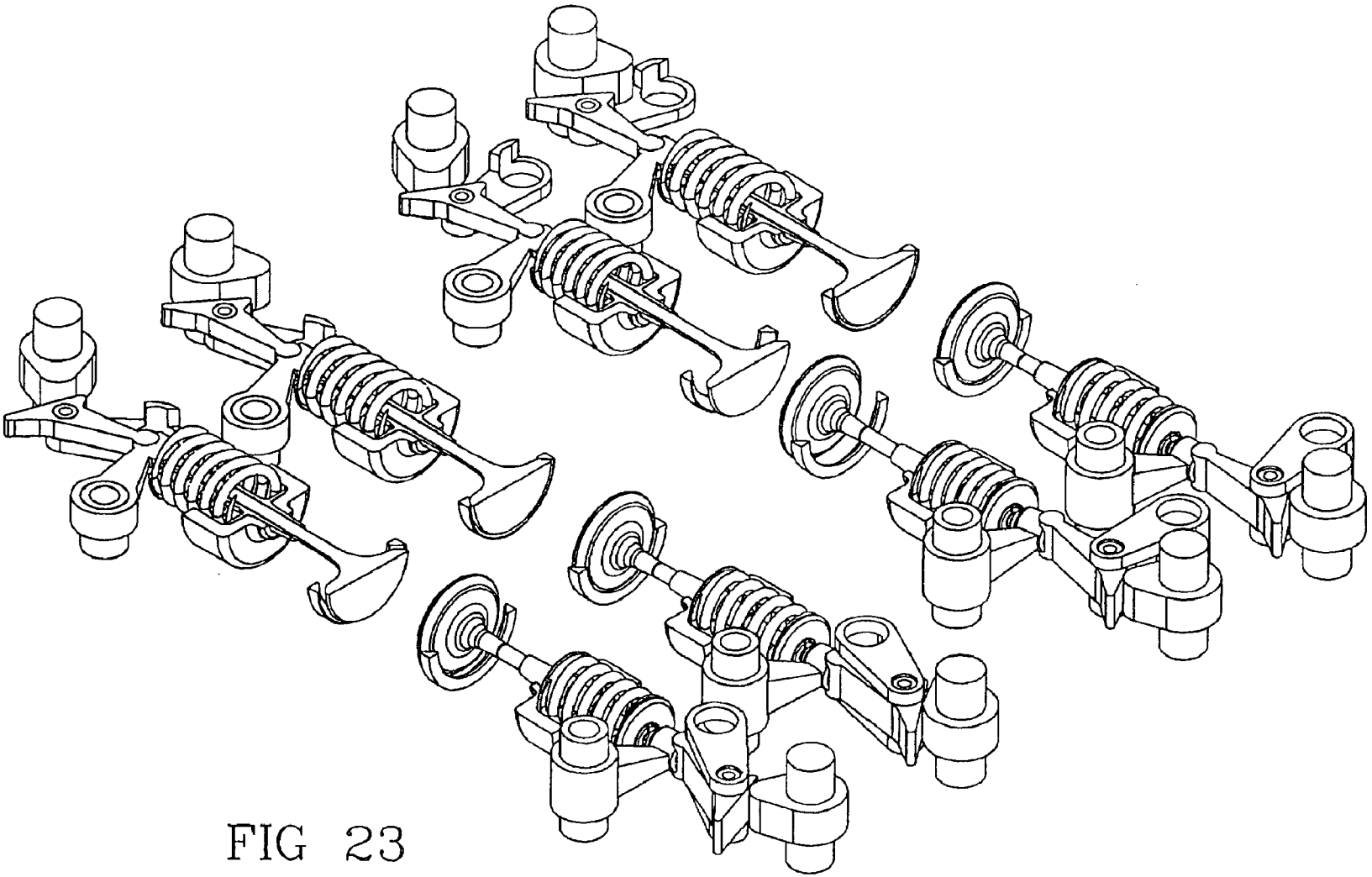

In FIG. 23 they are shown, from other points of view, the mechanisms shown in FIGS. 19 to 22.

Figures 5, 6, 7:
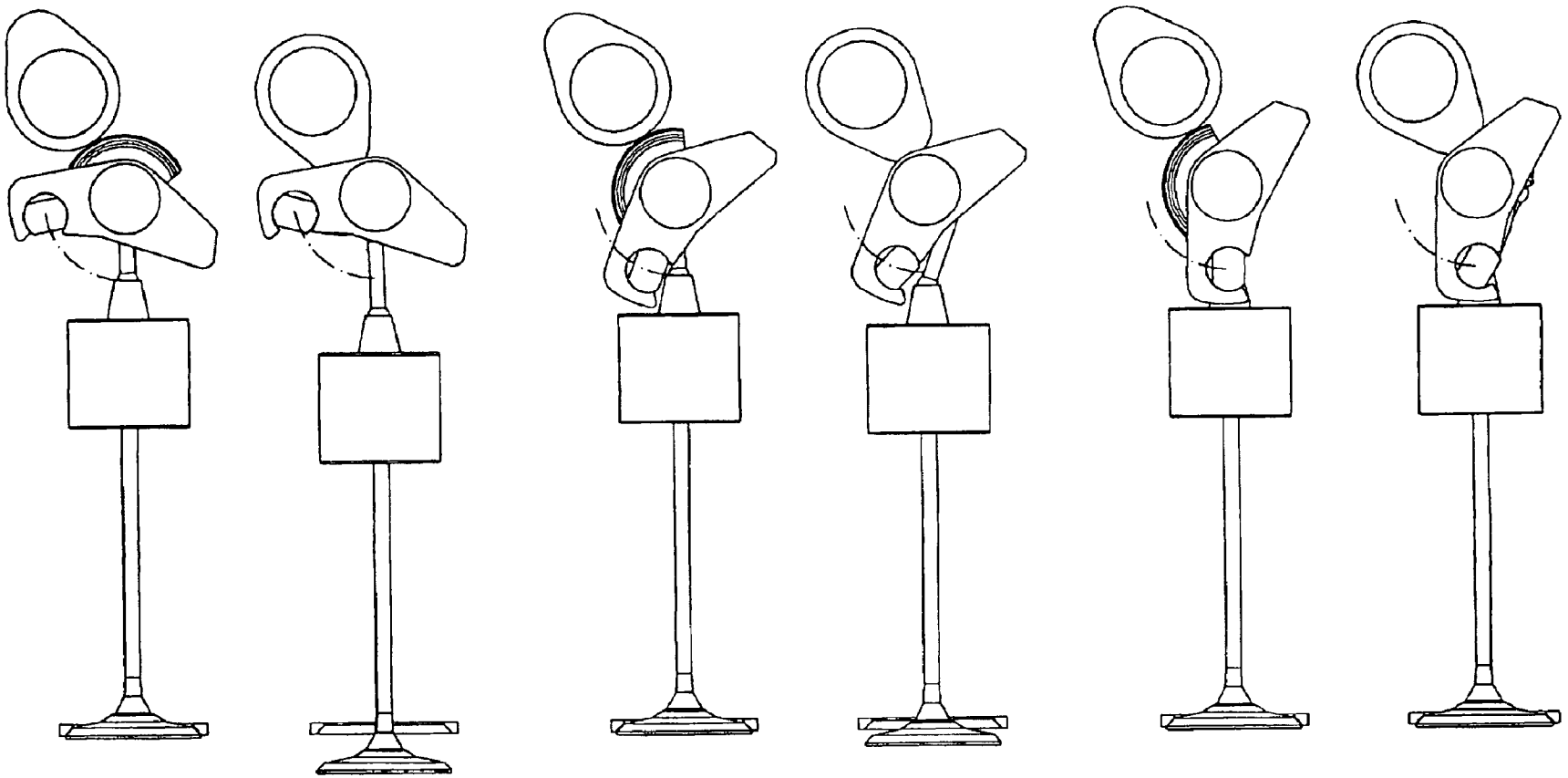
FIG. 5 shows the mechanism of FIG. 1 for two angles of the camshaft, adjusted for long valve stroke.
FIG. 6 shows the mechanism of FIG. 1 for two angles of the camshaft, adjusted for an intermediate valve stroke.
FIG. 7 shows the mechanism of FIG. 1 for two angles of the camshaft, adjusted for a very short or zero valve stroke.
Figure 24:
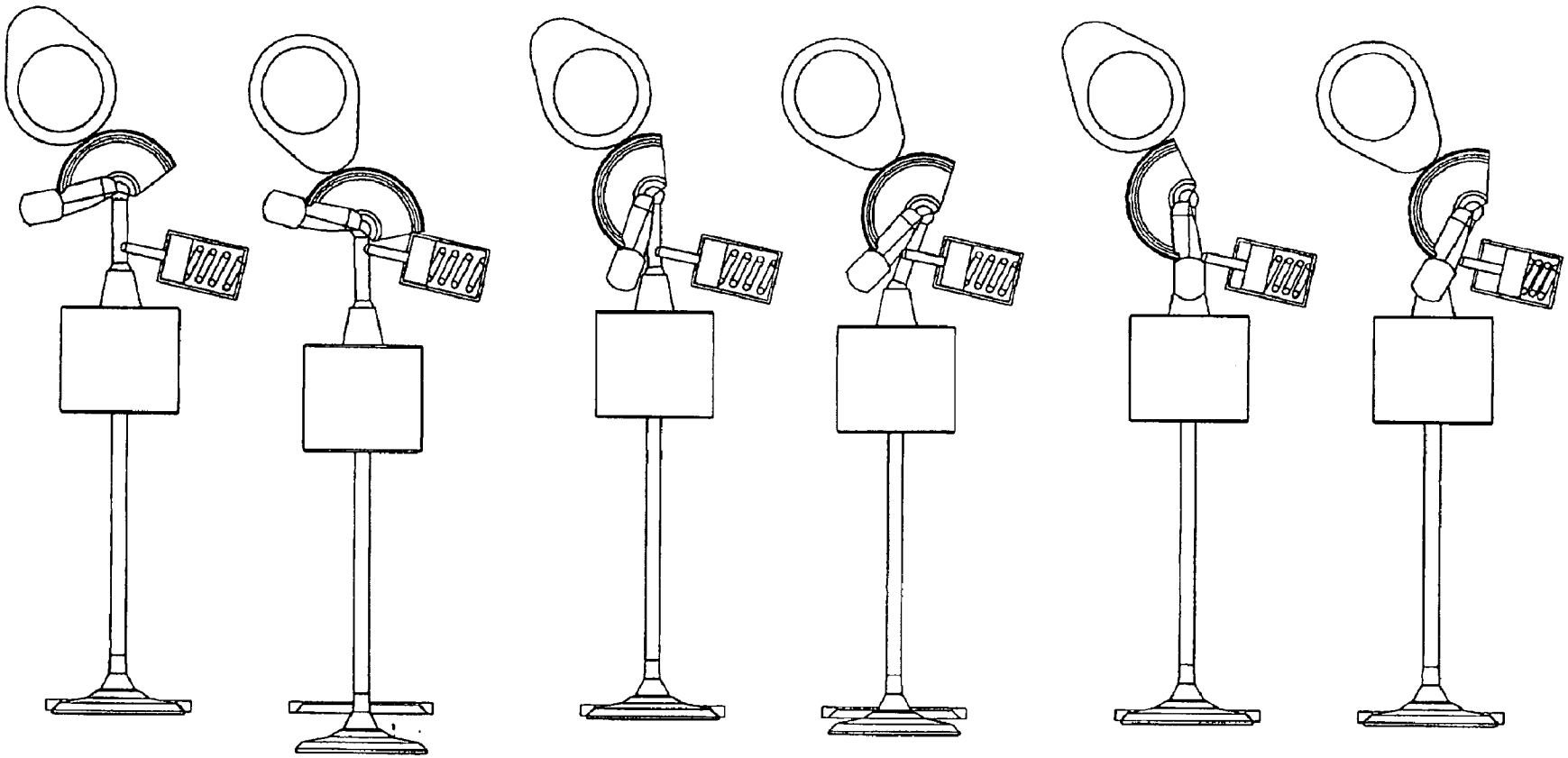

FIG. 24 shows a realization of the present invention with an additional spring member for providing the necessary restoring force to assist the contact of the cam follower to the control cam, at short valve strokes. The mechanisms shown are exactly the mechanisms shown in FIGS. 5, 6 and 7 with the control shaft removed for clarity, and with the addition of a spring member. The spring member comprises a spring inside a case secured to the engine casing, not shown, and a stem. The spring pushes linearly the stem. At long valve strokes the spring and the stem are idle at their outmost position. For short valve strokes the stem comes in contact to the control lever, offering the necessary restoring force to secure the contact of the cam follower to the control cam. For short valve strokes the restoring force, from the spring member, is added to the restoring force from the valve spring. Only at zero valve stroke all the restoring force is generated by the additional spring member. If zero valve stroke is not used at all, and if the short valve strokes are only for low revs, an additional spring member is not necessary.

Figure 25:
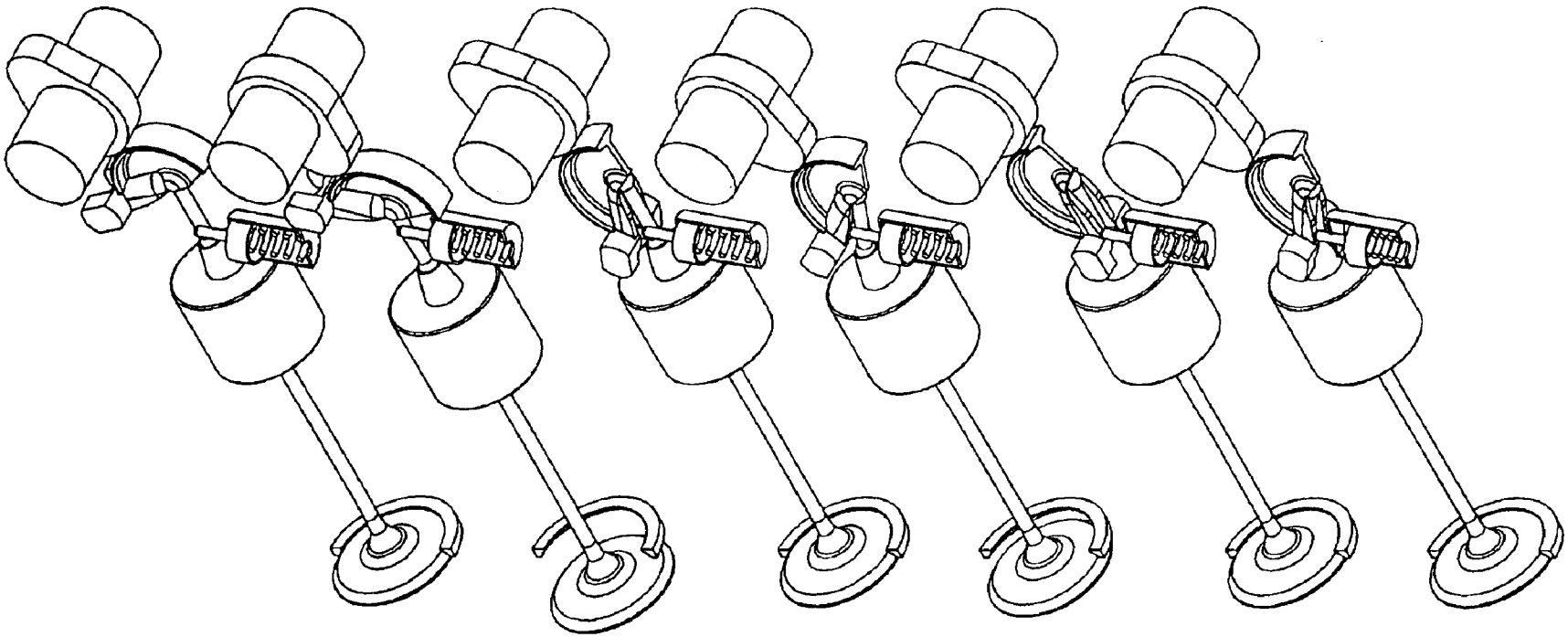

FIG. 25 shows the mechanisms of FIG. 24 from another point of view.

Referring to the mechanism shown in FIGS. 1 to 12, 1 is the camshaft, 2 is a control cam mounted on said camshaft 1, 3 is a cam follower having a cylindrical shape and being mounted to the control lever 8. Said control lever 8 is rotatably supported at its end 17 to a control shaft 7, to rotate about an axis 9 of the control shaft 7. The control shaft 7 is rotatably supported to the engine frame, not shown, to rotate about a fixed to said engine axis 10. The control lever 8 is swivellably coupled, at its other end 11, to the valve lever 6. The swivel joint coupling the control lever 8 and the valve lever 6 comprises a spherical surface 12 at the end of the valve lever 6, inserted into a corresponding spherical cavity 11 of the control lever 8. At the other end the valve lever 6 is swivellably coupled to the bucket lifter 5, or valve displacing device 5, of the valve 4. The swivel joint coupling the valve lever 6 and the bucket lifter 5 is comprises a spherical surface 13 at the end of the valve lever 6, inserted into a corresponding spherical cavity 18 of the bucket lifter. The valve 4 has a corresponding valve seat 14 to rest when it is closed. The effective length of the control lever 8, the effective length of the valve lever 6 and the distance from the axis 10 to the axis 9 are all selected to be substantially equal. The location of the control shaft 7, or adjusting device 7, is selected so that the axis 10 passes substantially through the center of the swivel joint coupling control lever 8 and valve lever 6, when the valve 4 is closed. As the camshaft 1 rotates, the cam follower 3 is forced to perform a motion. The bearing 16 on the adjusting device 7, in cooperation with the end 17 of the control lever 8, allows to the control lever 8 just an angular displacement about the axis 9 of the adjusting device 7. Through the two swivel joints, 11 to 12 and 13 to 18, the valve lever is pushed, at the end 12, from the control lever 8, and is pushing, at the end 13, the bucket lifter 5 which can move only linearly, so the rotation of the control cam 2 is translated to angular oscillation of the control lever 8 and then, by means of the valve lever 6, to linear oscillation of the bucket lifter 5 and valve 4. To change the valve stroke it suffices to rotate, about the axis 10, the control shaft 7. In case the axis 9 of the adjusting device 7 is displaced to pass through the center of the swivel joint coupling valve lever 6 and bucket lifter 5, the stroke of the valve 4 becomes zero. With the mechanism proposed can be achieved both, substantially constant valve clearance and ability for valve strokes continuously variable from a maximum to zero.

The longer the valve stroke, the heavier the inertia loads. However at the long valve strokes is where the valve lever 6 remains almost parallel to the valve stem, FIG. 8 upper row, giving slighter thrust load to the bucket lifter 5. The restoring force, for securing the contact of the cam follower to the control cam, can be generated by the valve spring. If very short or even zero valve strokes are wanted, an additional spring could be located to provide the necessary force for holding in contact the cam follower 3 and the control cam 2, as shown in FIGS. 24 and 25. This spring can remain, as shown in FIGS. 24 and 25, completely idle at medium and long valve stroke operation.

Figure 3:
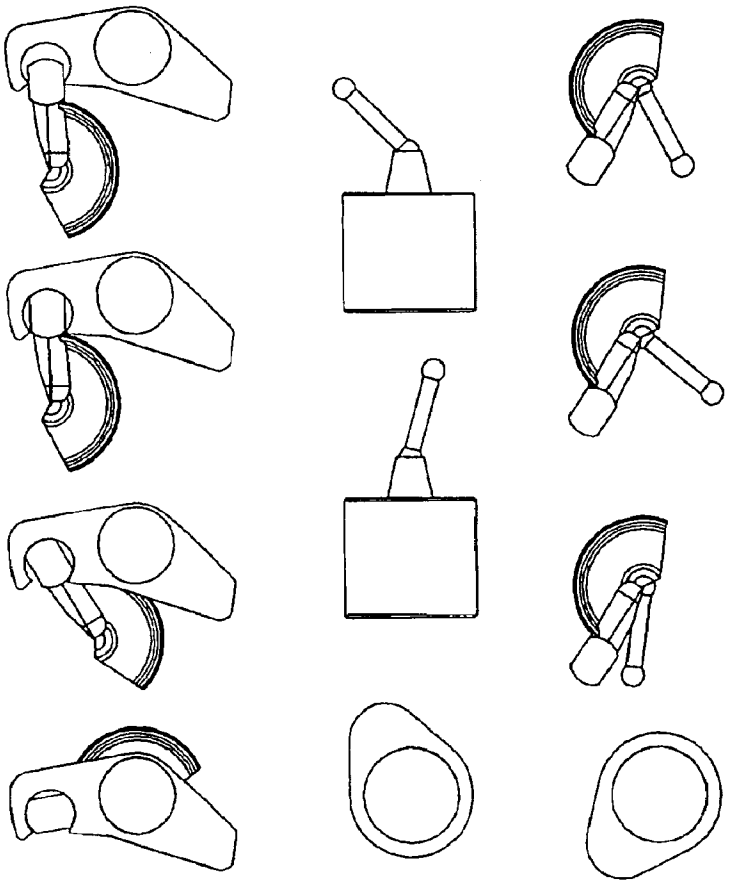
FIG. 3 shows the assembly and interconnection of the various constituents of FIG. 1.
Figure 2:
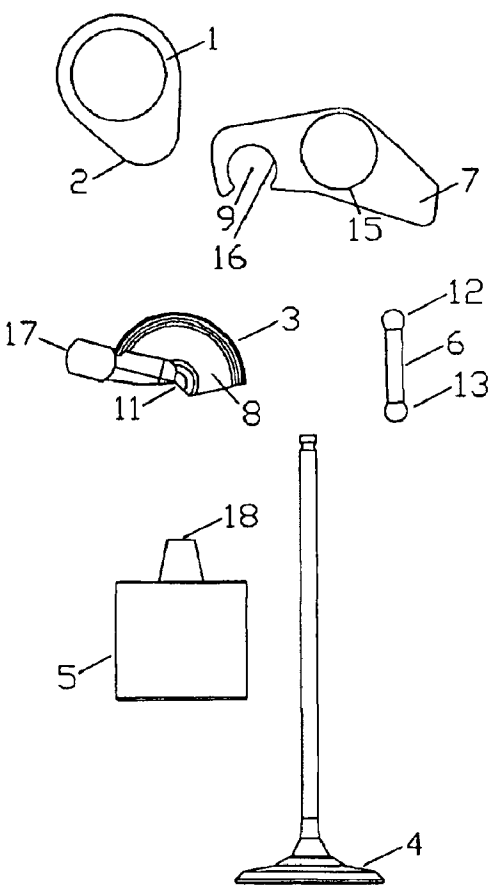
FIG. 2 shows a disassembly of the mechanism of FIG. 1.

In FIG. 3 it is shown the way for assembling the control lever 8 to the control shaft 7, or adjusting device 7. As the rotation angle of the control lever 8 about the axis 9 of the control shaft is limited, there is no need for 360 degrees bearing 16 and pin 17. In the way shown, for each valve in a row, just a control lever and a valve lever suffice. And for the whole row of valves it is needed only one common control shaft. The spherical swivel joints are not a necessity. They could also be cylindrical etc.

In case the effective lengths of control lever and valve lever, as well as the distance from 9 to 10 axis are not equal, again the mechanism works but, depending on the selected lengths and the location of the axis 10, the clearance of the valve may not be constant, and the available valve strokes may not include very short values.

The bucket lifter 5 can obviously have some hydraulic compensation element inside.

The operation principle, for the mechanism shown in FIGS. 13 to 18, is similar. The cam follower is a roller properly mounted to the control and valve levers. The adjusting mechanism is not shown, but with dash dot line is shown the path of the axis 9. The swivel joints are made with pins, one for the interconnection between the bucket lifter 5 and the valve lever 6, and one for the interconnection between the valve lever 6 and the control lever 8.

The mechanism shown in FIGS. 19 to 23 is a similar one. Here the valve displacing device 5 is a rocker arm. The swivel joint coupling the valve lever 6 and the rocker arm 5 comprises a cylindrical surface at the end of the valve lever 6, cooperating with a corresponding cavity of cylindrical form of the rocker arm. The cam follower has not a cylindrical shape, nevertheless the valve clearance can be constant and the valve stroke can continuously vary from a maximum to zero. The form of the cam is not necessarily plane or cylindrical.

If it is desirable to be changed slightly the valve clearance, depending on the valve stroke, the shape of the cam follower could be modified or a small offset from the theoretically perfect position of the axis 10 could be applied, or slightly different effective lengths, of control and valve levers, could be used.

In case of bevel or conical control cams, the previous could also be applied with some small modifications, obvious to the relevant of the art.

In case that different adjustment for the various valves in a row is wanted, the adjustment mechanism could be designed to be able to displace the axis 9 of each valve independently.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A variable valve gear of substantially constant valve duration with variable valve lift, comprising:

a cam shaft (1), a control cam (2) mounted on said cam shaft (1);

a cam follower (3);

a valve (4);

a valve displacing device (5) for displacing said valve (4);

a valve lever (6) between said cam follower (3) and said valve displacing device (5), said valve lever (6) being swivellably coupled to said valve displacing device (5);

the swivel joint between said valve lever (6) and said valve displacing device (5) being substantially a non-moving swivel joint connection as regards said valve displacing device (5);

a control lever (8) rotatable about a linearly displaceable axis (9) and swivellably coupled to said valve lever (6) at a swivel joint;

an adjusting device (7) for displacing said axis (9) along a path;

whereby the stroke of said valve (4) can be continuously variable from a maximum to a minimum, according the displacement of said axis (9) along said path.

2. A variable valve gear, as claimed in claim 1, characterized in that:

said axis (9) is movable at a substantially constant distance from a fixed engine axis (10);

thereby the stroke of said valve (4) is controlled by the angular displacement of said axis (9) about said fixed to said engine axis (10).

3. A variable valve gear, as claimed in claim 1, characterized in that:

said axis (9) is movable at a constant distance from a fixed engine axis (10);

said constant distance being substantially equal to the distance between said axis (9) and the center of said swivel joint;

thereby the clearance of said valve (4) can be constant, independent of the valve stroke of said valve (4).

4. A variable valve gear, as claimed in claim 1, wherein:

said control lever (8) has an effective length equal to the distance from said axis (9) to the center of the swivel joint coupling said control lever (8) and said valve lever (6);

said valve lever (6) has an effective length equal to the distance from the center of the swivel joint coupling said control lever (8) and said valve lever (6), to the center of the swivel joint coupling said valve lever (6) and said valve displacing device (5);

characterized in that:

said effective length of said control lever (8) is substantially equal to said effective length of said valve lever (6);

thereby when said axis (9) is displaced at the center of said swivel joint coupling said valve lever (6) and said valve displacing device (5), the stroke of said valve (4) becomes zero.

5. A variable valve gear, as claimed in claim 1, wherein:

said control lever (8) has an effective length equal to the distance between said axis (9) and the center of said swivel joint coupling said control lever (8) and said valve lever (6);

said valve lever (6) has an effective length equal to the distance between the center of said swivel joint, coupling said control lever (8) and said valve lever (6), and the center of the swivel joint coupling said valve lever (6) and said valve displacing device (5);

characterized in that:

said axis (9) moves sustaining a substantially constant distance from a fixed engine axis (10);

said effective length of said control lever (8) being substantially equal to said constant distance between said axis (9) and said fixed to said engine axis (10);

said effective length of said valve lever (6) being substantially equal to said constant distance between said axis (9) and said fixed to said engine axis (10);

thereby the stroke of said valve (4) can vary, according the angular displacement of said axis (9) about said fixed to said engine axis (10), from a maximum value to zero, while said valve (4) clearance is substantially constant for every stroke of said valve (4).

6. A variable valve gear, as claimed in claim 1, characterized in that:

a spring element provides force for keeping said cam follower (3) substantially in contact with said control cam (2).

7. A variable valve gear, as claimed in claim 1, characterized in that:

a spring element provides a force for keeping said cam follower (3) substantially in contact with said control cam (2) at short valve strokes, while it idles at long valve strokes.

8. A variable valve gear, as claimed in claim 1, characterized in that:

said adjusting device (7) controls more than one valves.

9. A variable valve gear, as claimed in claim 1, characterized in that:

said cam follower (3) is a roller rotatably supported to said valve lever (6), or to said control lever (8), or both.

10. A variable valve gear, as claimed in claim 1, characterized in that:

said cam follower (3) is made as a cylindrical shape surface secured to said control lever (8);

the center of said swivel joint coupling said control lever (8) and said valve lever (6) being substantially on the axis of said cylindrical surface;

said axis (9) moves sustaining a constant distance from a fixed engine axis (10);

said axis of said cylindrical surface being, when said valve (4) is closed, substantially on said fixed to said engine axis (10);

thereby the clearance of said valve (4) can be substantially constant as the displacement of said axis (9) varies.

11. A variable valve gear, as claimed in claim 1, characterized in that:

said cam follower (3) is mounted on said valve lever (6).

12. A variable valve gear, as claimed in claim 1, characterized in that:

said valve lever (6) being mere merely a push rod.

13. A variable valve gear as claimed in claim 1, characterized in that there is a hydraulic member for automatic clearance compensation.

14. A variable valve gear as claimed in claim 1, characterized in that said cam shaft is driven by means of a variable valve timing system in order to control both, the stroke and the timing of the valve.

* * * * *